United States Patent [19]

Wiard

[11] Patent Number: 4,623,019

[45] Date of Patent: Nov. 18, 1986

[54] HEAT EXCHANGER WITH HEAT TRANSFER CONTROL

[75] Inventor: Maxwell R. Wiard, Vandalia, Ohio

[73] Assignee: United Aircraft Products, Inc., Dayton, Ohio

[21] Appl. No.: 781,696

[22] Filed: Sep. 30, 1985

[51] Int. Cl.[4] ..... F28F 13/00

[52] U.S. Cl. ..... 165/146; 165/135; 165/166

[58] Field of Search ..... 165/70, 147, 166, 167, 165/146, 135

[56] References Cited

U.S. PATENT DOCUMENTS

| | | | |
|---|---|---|---|
| 2,344,588 | 3/1944 | Blauvelf | 165/146 |
| 2,846,198 | 8/1958 | Sturges | 165/70 |
| 3,161,234 | 12/1964 | Rannenberg | 165/147 |
| 3,229,764 | 1/1966 | Wane | 165/167 |
| 3,451,473 | 6/1969 | Urie et al. | 165/70 X |
| 3,469,623 | 9/1969 | Rawlings | 165/70 |
| 3,517,731 | 6/1970 | Rothman | 165/70 |
| 3,537,513 | 11/1970 | Austin et al. | 165/70 |
| 3,631,819 | 1/1972 | Houchmar | 165/146 |
| 3,880,232 | 4/1975 | Parker | 165/166 |
| 4,049,051 | 9/1977 | Parker | 165/166 |
| 4,473,111 | 9/1984 | Steeb | 165/153 |

FOREIGN PATENT DOCUMENTS

| | | | |
|---|---|---|---|
| 142466 | 1/1949 | Australia | 165/47 |
| 1125175 | 8/1968 | United Kingdom | 165/70 |

*Primary Examiner*—Albert W. Davis, Jr.
*Assistant Examiner*—Randolph A. Smith
*Attorney, Agent, or Firm*—J. E. Beringer

[57] ABSTRACT

A heat exchanger core of the plate and fin type having intrinsic capabilities of controlled resistance to heat flow. Objectives are achieved without a need for special materials and without departing from practiced structural and fabrication standards. A concept of resistance layers is used, with heat flux being controlled primarily in the resistance layers.

13 Claims, 6 Drawing Figures

HEAT EXCHANGER WITH HEAT TRANSFER CONTROL

BACKGROUND OF THE INVENTION

1. Field of the Invention

This invention relates to plate and fin type heat exchangers, and particularly to a heat exchanger core of controlled resistance to heat flow.

2. Description of the Prior Art

In the heat transfer arts, a known type of heat exchanger core is comprised of stacked plate elements and spacer elements forming a layered device in which fluids of different temperatures flow through adjacent layers. A transfer of heat occurs, through intervening plates, from the fluid of higher temperature to the fluid of lower temperature. Core parts are conventionally made of lightweight metals of good heat conductivity adaptable to being joined to one another by a brazing process. Plate elements are made as thin as structural considerations permit. Corrugated fin material between plate elements supports the plate elements and provides secondary heat transfer surface. Heat transfer between liquids, between gases and between liquids and gases commonly is undertaken in such core devices.

The so-called plate and fin type heat exchanger is and has been in general use, its construction having become largely standardized. Its use has not been obvious, however, in application of severe requirements, particularly when those requirements are involved in system operations. In one such application, a fluid normally in gaseous form (at other than very low temperatures) is precooled to a liquid form. In that form is is pumped to and through a heat exchanger where it is in heat transfer relation to another fluid of substantially higher temperature. In its passage through the heat exchanger the liquid is highly volatile. Rapid vaporization can induce pressure pulsations which, as reflected in the system of which the heat exchanger is a part, can have undesired consequences. Desirably, vaporization should proceed at a controlled rate and not in a burst of activity in early portions of the liquid flow paths. In attempting to cope with this problem it has been variously suggested that parts of the heat exchanger core should be made relatively heavy or should be made of different metals, or that dimensions of the core be substantially changed from those given heat transfer specifications may require. Disadvantages inhere in all such proposals, not the least of which is that all necessitate a use of nonstandard parts and special fabrication.

I am not aware of other proposed solutions to the described problem. I am aware of the teachings in Parker U.S. Pat. No. 3,880,232 and Parker U.S. Pat. No. 4,049,051. These relate to a different problem in that they attempt to avoid core splitting and cracking in a gas to gas heat exchanger. Moreover one suggests a use of combinations of metals and the other suggests progressive zoning in existing flow paths to improve thermal fatigue life.

SUMMARY OF THE INVENTION According to the present invention, a plate and fin type heat exchanger is assembled from conventional parts to a generally conventional form, but has in itself the capability of controlled heat flow. In a multi-sided core, plate elements and spacer elements are stacked in a layered assembly providing fluid passages for different fluids to flow in a segregated heat transfer relation to one another. At least at each of certain locations in the stacked assembly a layer includes spacer elements substantially closing all sides of the core to define between adjacent fluid flow passages a no-flow layer of increased heat transfer resistance. Fin strips of differing heat transfer capabilities position within the resistance layer which becomes a thermal control space between flowing fluids of high temperature difference. The fin strips are selected and arranged to bear a determined relation to the paths of flow in fluid flow layers above and below or adjacent to the resistance layer, and to an expected dynamic activity of one of the flowing fluids.

An object of the invention is to introduce a concept of thermal control in a plate and fin type heat exchanger core by inserting layers of controlled heat flow resistance between fluid flowing layers, it being an attendant object to obviate a need for special metals and special fabrication techniques.

In a more specific aspect it is the invention object to provide a heat exchanger in which heat transfer per surface unit area is controlled to prevent large pressure pulsations caused by too rapid phase change of one of the fluids.

Other objects and structural details of the invention will appear from the following description when read in connection with the accompanying drawings, wherein.

Figure 1:
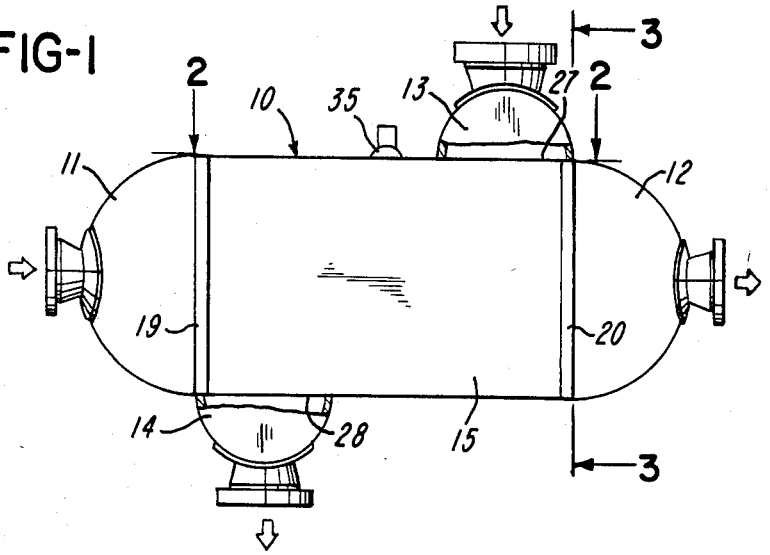
FIG. 1 is an upper plan view of a heat exchanger according to an illustrated embodiment of the invention, portions being broken away for clarity.

Referring to the drawings, a heat exchanger according to the illustrative embodiment is adapted for illustration in systems pumping or otherwise initiating flows of first and second fluids. It includes a heat exchanger cores 10 to end faces of which are attached manifolds 11 and 12 and to opposite side faces of which are attached manifolds 13 and 14. As will later more clearly appear, manifold 11 acts as the inlet for a first fluid which, after passing through core 10, collects in and discharges from manifold 12 as the outlet. Similarly, a second fluid enters the heat exchanger at inlet manifold 13 and, after being led through the core 10, leaves by way of outlet manifold 14.

The core 10 comprises a stacked assembly of parts joined to one another, as by brazing, to form a unitary core structure, At top and bottom of the structure are core sheets 15 and 16. At end extremities, the sheets 15 and 16 are overlaid by doubler strips 17–18 and 19–20 that, along with the relatively thick core sheets, provide adequate abutment surface for engagement by the manifolds. The latter are fixed to respective core faces by welding or the like.

Figure 2:
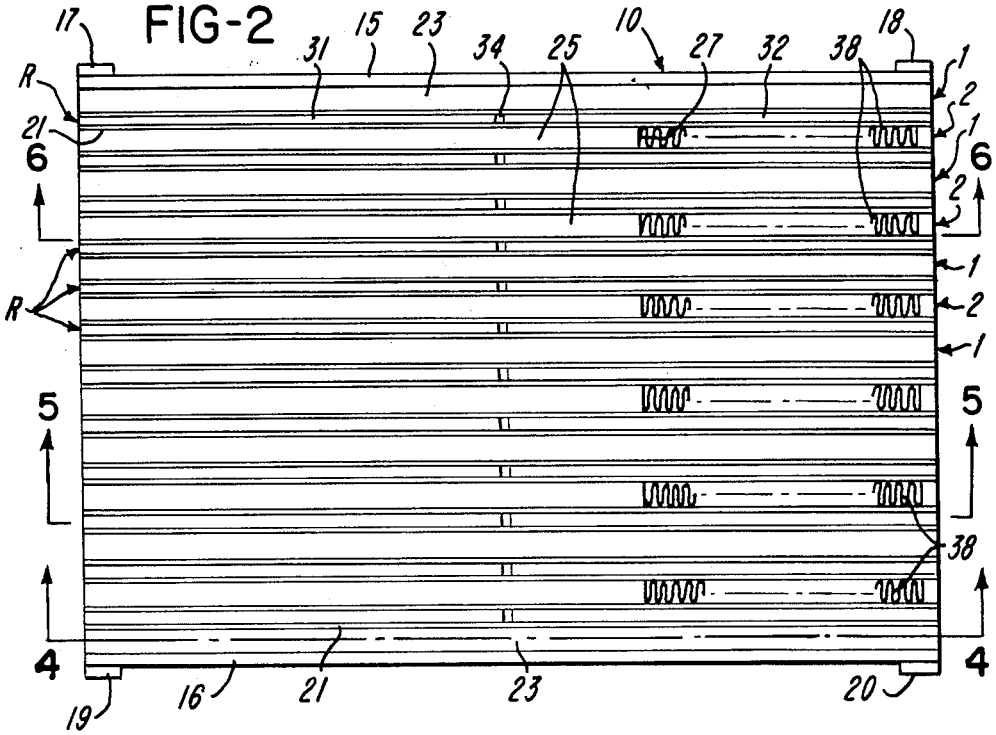
FIG. 2 is a view in side elevation of one side face of the heat exchanger core, being taken substantially along the line 2—2 of FIG. 1, and relatively enlarged.
Figure 3:
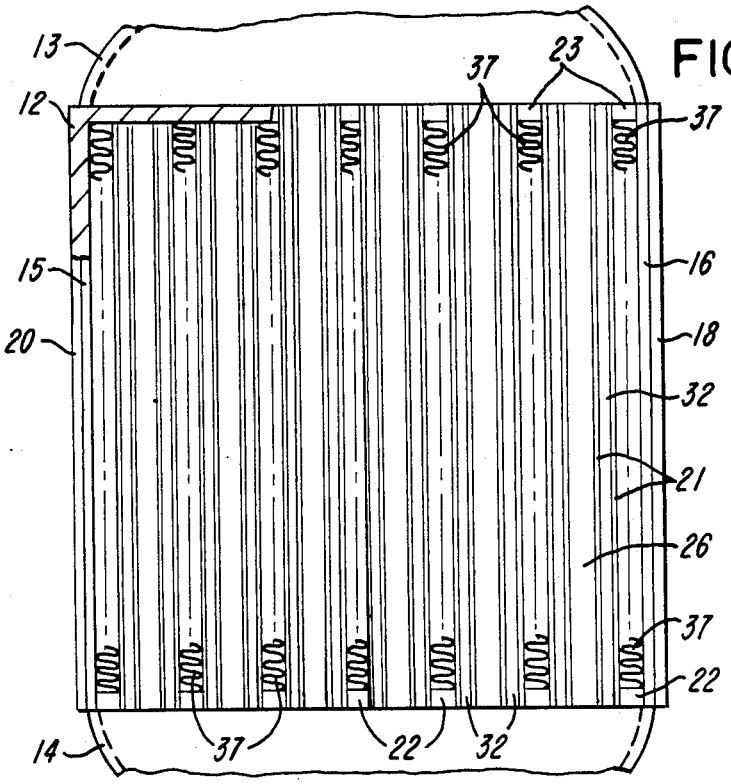
FIG. 3 is a view in elevation of one end face of the core, taken substantially along the line 3—3 of FIG. 1, an relatively enlarged.

The core sheets are relatively heavy plate elements, and, between them is a number of lighter, thinner plate elements termed tube sheets. The thinner plate elements, since they are identical to one another are commonly designated by reference numeral 21. The tube sheets overlie or superimpose on one another but are separated by spacer members. These may be differently configured and differently arranged so that they will be individually identified. Together the tube sheets and spacer members give the heat exchanger core a layered construction, with some layers being used as flow paths for the described first fluid and others being used as flow paths for the described second fluid. Further, and as will be seen, still other layers function as thermal control spaces. Each thermal control layer is sandwiched by or positions between a first fluid flow path and a second fluid flow path. For clarity sake the thermal control layers are indicated in the drawings (FIG. 2) by reference character "R". Similarly, the flow path layers conducting the described first fluid are indicated at 1 and those conducting the described second fluids are indicated at 2.

Figure 4:
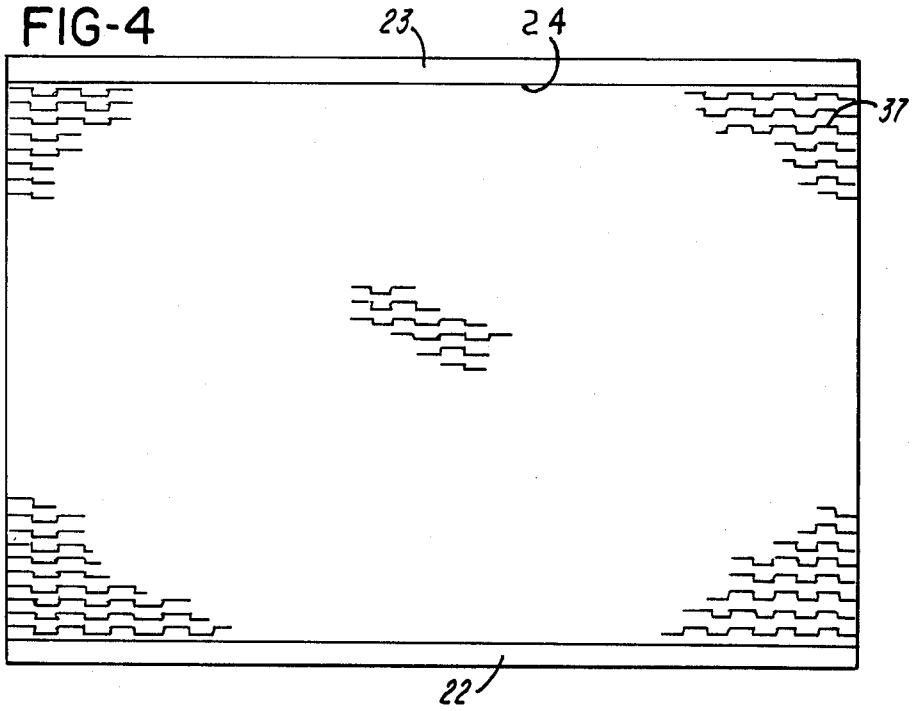
FIG. 4 is a view taken substantially along the line 4—4 of FIG. 2 showing the flow path of one of the fluid flowing layers.
Figure 5:
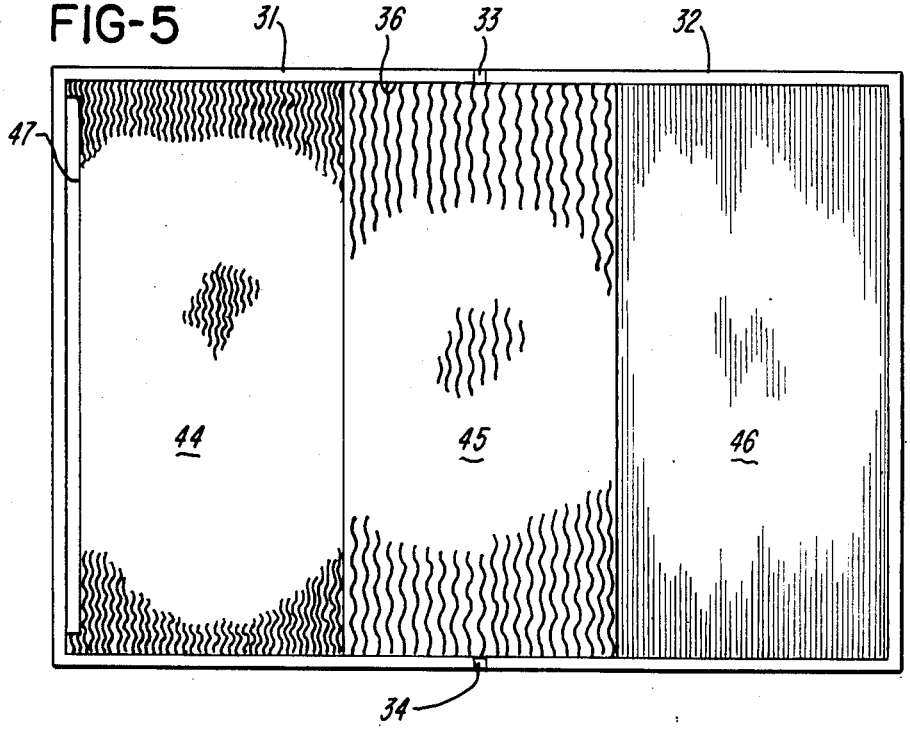
FIG. 5 is a view through a thermal control layer, taken substantially along the line 5—5 of FIG. 2.

Layers 1 adjacent a core sheet 15 or 16 are comprised of the core sheet, a spaced tube sheet 21 and spacer elements 22 and 23. As shown in FIG. 4, elements 22 and 23 are straight, bar-like elements rectangular in cross section so that core sheets and tube sheets can seat flushly to upper and lower surfaces. They position between opposite side margins of the plate or sheet elements effectively closing a layer 1 at its sides but leaving it open from end to end. The remaining layers 1 are constructed in like manner, using like spacer members 22 and 23 and using adjacent tube sheets 21 instead of a core sheet and a tube sheet. Superposing plate elements and interposed spacer elements may be regarded as forming at each layer 1 a straight through passage 24 opening at opposite ends of the core through the core end faces. One core end face being closed by manifold 11 and the other by manifold 12, the several flow passages 24 define a confined route through the core for the described first fluid in moving from inlet manifold 11 to outlet manifold 12.

Figure 6:
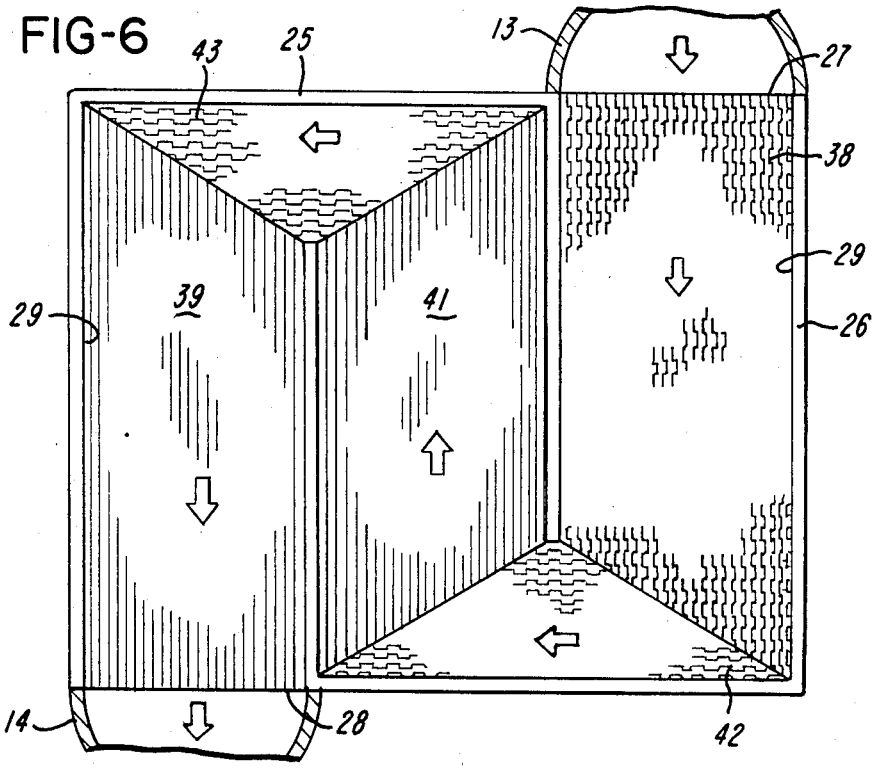
FIG. 6 is a view taken substantially along the line 6—6 of FIG. 2, showing the flow path at another of the fluid flowing layers.

Each layer 2 is comprised of an overlying and an underlying tube sheet 21 and of interposed spacer elements, in this instance best seen in FIG. 6. There are two spacer elements 25 and 26. These are in cross sectional shape like the spacer elements 22 and 23 and are or may be substantially identical to one other. They are bent to a U-shape, each having legs of unequal length. In the assembly process, the spacer elements are laid upon an underlying tube sheet with legs of shorter length in an interfitting longitudinally spaced apart relation. Legs of greater length position at opposite marginal ends of the tube sheet and effectively close those ends of the layer 2 adjacent to manifolds 11 and 12. Closed configurations of the U-shape position along opposite side margins of the tube sheet and close portions of opposite sides of the layer 2. Other such side portions, corresponding in length to the distance between the longer leg of one spacer element and the shorter leg of the other spacer element are open. The arrangement provides inlet apertures 27 at the location of each layer 2 on one core side face and outlet apertures 28 at like locations on the other core side face. Manifold 13 attaches to one core side face in overlying communicating relation to inlet apertures 27. Manifold 14 attaches to the other core side face in overlying communicating relation with outlet apertures 28. A flow path 29 through each layer 2 is defined, from inlet aperture 27 to outlet aperture 28 with such path taking a serpentine course as enforced by the interfitting shorter legs of the spacer elements.

The thermal control layers R are essentially no-flow chambers in that they are not in the path of flow of either described fluid. Each is comprised of overlying and underlying tube sheets 21 separated by spacer elements which effectively close each layer R at all core faces. The spacer elements in this case comprise bar-like elements 29 and 31 like those previously discussed but having a U-shape with legs of equal length. In placing the elements 31 and 32 on an underlying tube sheet 21 they are oriented in an opposing relation with respective leg ends in an approaching relation to one another. Closed ends of the spacer members respectively close each layer R at end faces of the core. Legs cooperate with one another in substantially closing side core faces at each layer R location. The arrangement is one to produce narrow gaps 33 and 34 at side locations. A manifold 35 overlies the multiple gaps 33 and is adapted to be connected to a remote source of fluid pressure or to a vacuum pump or the like. At will, the interiors of layers R each of which may be regarded as presenting a chamber 36, may be connected to ambient surroundings or to a source of pressure fluid or to subatmospheric pressure. Since, as noted, the thermal control layers R are excluded from the flow paths of involved fluids, nose pieces 31 and 32 are necessary only to the extent that they fill structural needs and to the extent it may be important to define a chamber 36.

It will be understood that tube sheets 21 which form the multiple core layers are common to adjacent layers. Thus, a tube sheet defining a lower wall of a layer 1 is the same tube sheet forming the upper wall of the adjacent thermal control layer R. No special sheet material is used in constructing the layers R. Spacer elements 31 and 32 are conventional except for being bent to the shapes indicated. Assembly of the core is done in a usual fashion, selecting and stacking what are essentially conventional parts and subjecting the completed assembly to a brazing operation.

In the straight through passages 24 of layers 1 are lanced, offset fin strips 37. Peaks and valleys of the strips 37 contact and are brazed to overlying and underlying tube sheets 21. The fin strips support the relatively thin tube sheets and provide secondary heat transfer surface.

In the serpentine flow passage 29 of each layer 2 is a series of fin strips successively encountered by the described second fluid. The strip series comprises a segment 38 in what may be considered an entrance portion of passage 29, a segment 39 in what may be considered an exit portion of passage 29, a segment 41 in a mid passage portion and turn-a-round segments 42 and 43. Together, the strip segments 38, 39, and 41-43 fully occupy the passage 29 and make contact with overlying and underlying tube sheets 21. Considering each passage 29 to be occupied in the main segments 38, 39 and 41, it may be said that fin corrugations in the passages 29 extend at right angles to the corrugation of fin strips 37 in passages 24. The latter, it will be noted, extends in the direction of fluid flow.

In the thermal control layers of spacers R, each chamber 36 is occupied by fin strips 44, 45 and 46. These correspond in location to the locations of fin strips 38, 39 and 41, and, like those strips, orient transversely of fin strips 37. Thus, with respect to fin strip 44, this strip may be regarded as overlying or underlying strip segment 39 in the exit portion of passage 29 and, with respect to adjacent passage 24, strip 44 positions at or adjacent to what may be regarded as the entrance end portion of that passage. Similarly, strip 45 is in mid-passage position while strip 46 is between the entrance portion of an adjacent passage 29 and an exit portion of an adjacent passage 24. Strips 44, 45 and 46 bear a like relation to overlying and underlying tube sheets 21 as do fin strips in the layers 1 and 2. In this instance, however, they act principally as tube sheet supports and as heat flow controllers between overlying and underlying sheets. The effectiveness with which heat may be conducted can be made to be a function of fin density, that is, the number of fin corrugations per inch of a fin strip. With this in mind, and since it is in the illustrated instance desirable to have a high degree of resistance to heat flow at a mid-section of the core, having regard to flow of the described first fluid, fin strip 45 is made to have a small number of fins per inch. Strip 46 positioning at the outlet end of the core, with respect to the described first fluid, and at an entrance end with respect to the second described fluid, is on the other hand made to have a larger number of fins per inch. Fin strip 44 at the inlet end of the core, with respect to the described first fluid, has an intermediate number of fins per inch. By way of example, an actual embodiment of the invention may find strip 44 with eighteen FPI, strip 45 with six FPI and strip 46 with twenty-eight FPI.

The layers R in interposing between adjacent layers 1 and 2 resist heat flow between the fluid flowing layers. More particularly, however, they exercise a control over heat flow with the view of controlling reactions in the fluid flowing passage. If, for example, the described first fluid is a liquified gas and the described second fluid is another gas in its normal state, the gas in a passage 29 will have cooled substantially by the time it reaches the exit segment of the passage, that is, at the time it is moving over fin segment 39. However, there is still a large temperature difference between the gas preparing to exit the core and the liquified gas just entering the core. If uncontrolled, the resulting accelerated vaporization of the liquid can cause pressure pulsations damaging to system operation. The resistance layers R, and especially in the presence of fin strips 44–46, control the heat flux, suppressing violent vaporization while insuring that before the described first fluid leaves the heat exchanger core its temperature has been raised in accordance with operating specifications. Heat flow or transfer in the heat exchanger core is controlled primarily in the resistance layers. The strip 44 may have cut out portions of no heat conductions, and such a portion 47 is shown in one end thereof.

Fin material may take differing structural forms. It may be plain, with straight-sided corrugations, as in the case of strips 39 and 41. It may be ruffled, as in the case of strips 44 and 45, and it may be lanced as in the case of strips 37, 38, 42 and 43. By using a combination of such configurations, it is possible to achieve more precisely a particular resistance to fluid flow or a particular distribution of such flow as will best achieve desired rates of heat transfer at different core locations.

The fin material in layers 1, that is the layers in which the described first fluid enters as a liquid, is, as noted, a lanced, offset fin material. As such it imposes substantial resistance to fluid flow and has a restrictive, distributive effect thereon.

The liquified gas enters layers 1 in what may be expected to be a sub-cooled condition. In an initial core section, corresponding to a portion of a resistance layer R occupied by fin strip 44, the sub-cooled liquid absorbs heat and approaches a saturation point or temperature of vaporization. It reaches that temperature at about the point at which it enters a center core section corresponding to the location of resistance layer strip 45. There in an area of maximum resistance to heat flow, the liquid undergoes a gradual change of phase from liquid to gas, maintaining latent heat conditions. In a final core section, corresponding to the location of resistance layer strip 46, the fluid now in gas form absorbs heat rapidly and discharges from the core in a super heated condition. Excessively dynamic activity in the layers 1 is accordingly inhibited and controlled, with lanced fin 37 having an additional suppressing effect.

In layers 2, fluid flow has been shown as occurring in a serpentine path. Concepts of thermal control here expressed are applicable also to constructions in which the fluids flow in a more obvious counterflow relation or in a parallel relation.

What is claimed is:

1. A multi-sided plate and fin type heat exchanger core in which plate elements, intermediately positioning spacer elements and fin strips are stacked in a layered assembly providing fluid passages for different fluids to flow in a segregated heat transfer relation to one another; characterized in that at certain locations in a stacked assembly layers include spacer elements substantially closing all sides of the heat exchangers to define between adjacent fluid passages layers of increased heat transfer resistance, said fin strips being sheet-like elements corrugated to forms specifically identifiable in terms of fins per inch, there being fin strips in at least certain resistance layers differing in terms of fins per inch from other strips in said certain resistance layers.

2. A heat exchanger core according to claim 1, said spacer elements at said certain locations including a gap communicating respective resistance layers with ambient surroundings.

3. A heat exchanger core according to claim 1, spacer elements in fluid flowing layers adjacent said certain resistance layers positioning to direct fluid flow through said adjacent layers in selected flow paths, the fin strips in said certain resistance layers being selected and arranged with reference to the paths of flow of adjacent flowing fluids.

4. A heat exchanger core according to claim 3, spacer elements in one fluid flowing layer positioning to direct fluid flow there-through in a serpentine path, fin strips in an adjacent resistance layer comprising plural side by side strips, each positioned in correspondence with a segment of the serpentine fluid flow path.

5. A heat exchanger core according to claim 4, the serpentine fluid flow path having an entrance segment and an exit segment in a laterally spaced apart relation to one another, fin strips in an adjacent resistance layer positioned in correspondence with said entrance and exit segments being formed differently from one another in terms of fins per inch.

6. A heat exchanger core in which multiple stacked plate elements are separated by spacer elements which define flow paths for fluids to flow between adjacent plate elements, said spacer elements being arranged to form inlets and outlets to and from the core for different flowing fluids which within the core are in a heat transfer relation to one another through said plate elements; means defining a no-flow thermal control space between at least certain adjacent flow paths of different fluids, and at least one corrugated fin strip in said thermal control space having peaks and valleys in respective contact with adjacent plate elements for heat transfer between said plate elements, there being plural fin strips in said thermal control space occupying respectively different space segments, differing fin strips being differently characterized in a structural sense to have different heat transfer capabilities in respective space segments occupied thereby.

7. A heat exchanger core, including superposing plate elements, spacer elements separating said plate elements and forming with said plate elements confined flow paths for flowing fluids, said spacer elements being so arranged with respect to one set of formed flow paths as to define inlet ends for said one set of flow paths at one core face location and outlet ends at another core face location, and said spacer elements being so arranged with respect to another set of fluid flow paths as to define inlet ends for said another set of flow paths at a further core face location and outlet ends at a still further core location, and corrugated fin strips in at least certain flow paths positioning between and in contacting relation to adjacent separated plate elements, said one set of flow paths and said another set of flow paths conducting different fluids through said core, the arrangement of said spacer elements placing said sets of flow paths in an alternating relation to one another for a transfer of heat from one fluid to another through path separating plate elements, and additional spacer elements between at least certain adjacent plate elements defining between adjacent flow paths thermal control spaces of relatively high heat transfer resistance, said additional spacer elements substantially closing said thermal control space at all core face locations, and additional fin strips in said space differentially structured for differential heat transfer effectiveness at different locations in said space.

8. A heat exchanger core according to claim 7, the inlet ends of the flow paths for one flowing fluid being adjacent the outlet ends of the flow path for the other flowing fluid, a fin strip of maximum heat transfer effectiveness positioning in a thermal control space location corresponding to a segment of the inlet ends of the flow paths for said one flowing fluid.

9. A heat exchanger core according to claim 7, and means for varying the pressure in said thermal control spaces.

10. A heat exchanger core, including superposing plate elements, spacer elements, separating said plate elements and forming with said plate elements confined flow paths for flowing fluids, said spacer elements being so arranged with respect to one set of formed flow paths as to define inlet ends for said one set of flow paths at one core face location and outlet ends at another core face location, and said spacer elements being so arranged with respect to another set of fluid flow paths as to define inlet ends for said another set of flow paths at a further core face location and outlet ends at a still further core location, and corrugated fin strips in a least certain flow paths positioning between and in contacting relation to adjacent separated plate elements, said one set of flow paths and said another set of flow paths conducting different fluids through said core, the arrangement of said spacer elements placing said sets of flow paths in an alternating relation to one another for a transfer of heat from one fluid to another through path separating plate elements, and additional spacer elements between at least certain adjacent plate elements defining between adjacent flow paths thermal control spaces of relatively high heat transfer resistance, said core having entrance, center and exit sections having regard to the direction of fluid flow through one of said sets of flow paths, and fin strips in a thermal control space differentially constructed to vary the thermal resistance across said space in different core sections.

11. A heat exchanger core according to claim 10, a fin strip in a center core section being constructed to offer a resistance to heat flow greater than that offered at entrance and exit core sections.

12. A heat exchanger core according to claim 11, the flow paths of said one set being straight through the core and being occupied by lanced offset fin material.

13. A plate and fin heat exchanger core in which plate elements and fin strips are stacked in a layered assembly providing fluid passages for different fluids to flow in a separated heat transfer relation to one another, said assembly including at least at certain locations layers occupied by fin strips but excluded from paths of fluid flow, said last mentioned layers exercising thermal control over heat transfer between fluids in adjacent fluid flow passages, said core having entrance, center and exit sections having regard to the direction of flow therethrough of one of the different fluids, the fin strip in a thermal control layer being differentially constructed to vary the thermal resistance across said thermal control passage in different core sections.

* * * * *